United States Patent [19]

Lenz

[11] 4,068,737

[45] Jan. 17, 1978

[54] SAFETY DEVICE FOR MOBILE WORK PLATFORM LIFT

[75] Inventor: Leonard L. Lenz, Greenville, S.C.

[73] Assignee: American Mobile Corporation, Greenville, S.C.

[21] Appl. No.: 587,330

[22] Filed: June 16, 1975

[51] Int. Cl.[2] ..... E04G 1/18; E04G 1/34

[52] U.S. Cl. ..... 182/63; 182/146; 187/88

[58] Field of Search ..... 182/103, 102, 145, 141, 182/146, 63; 187/86, 87, 88, 85, 84, 83, 82, 81; 11, 10

[56] References Cited

U.S. PATENT DOCUMENTS

| | | | |
|---|---|---|---|
| 262,861 | 8/1882 | Voerde | 187/87 |
| 324,493 | 8/1885 | See | 187/88 |
| 1,023,711 | 4/1912 | Balazs | 187/82 |
| 2,241,275 | 5/1941 | Shinn | 187/11 |
| 2,757,756 | 8/1956 | Warry | 187/11 |
| 2,804,175 | 8/1957 | Phillips | 187/86 |

FOREIGN PATENT DOCUMENTS

| | | | |
|---|---|---|---|
| 164,444 | 6/1921 | United Kingdom | 187/85 |

*Primary Examiner*—Reinaldo P. Machado
*Attorney, Agent, or Firm*—Bailey, Dority & Flint

[57] ABSTRACT

A mobile work platform lift assembly is illustrated wherein a platform carriage is movable up and down by power operated cables on rails carried by a tower. The tower is movable from a horizontal to a vertical position. A safety mechanism is provided for locking the platform carriage with respect to the rails when the tower is in a vertical position if for any reason the cables no longer offer support for the carriage and when the tower is in a lowered horizontal position, the same mechanism fixes the platform carriage with respect to the rails to avoid longitudinal movement of the platform carriage with respect to the tower.

3 Claims, 4 Drawing Figures

SAFETY DEVICE FOR MOBILE WORK PLATFORM LIFT

BACKGROUND OF THE INVENTION

Self propelled aerial platforms of many different kinds have been provided. The most common are of the type employing a hydraulically operated boom as illustrated, for example, in U.S. Pat. Nos. 3,584,705 and 3,776,367, wherein the platform is attached permanently adjacent the free end of the boom. Other devices use telescoping towers and other expedients for raising the work platform. The present invention is concerned with an improvement in mobile work platform lift assemblies wherein a platform carriage is movable up and down on a tower by means of cables. The tower itself may be raised from a substantially horizontal lowered position to an upright substantially vertical position.

SUMMARY OF THE INVENTION

The improvement concerns a safety mechanism which employs spring actuated linkage mechanism maintained in a position, responsive to the lifting or supporting force of the cable, to normally maintain a wedging mechanism out of engagement with the rails carried by the tower. Upon relaxation of tension in the cable, a wedging means is actuated responsive to a spring to lock the platform carriage with respect to the rails as a result of the wedging force. The wedging force tilts the carriage into engagement with a stop means where it remains in wedged engagement until the necessary repairs have been made.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a mobile work platform lift assembly wherein a power operated wheeled vehicle carries a pivoted tower movable from a substantially horizontal lowered position to an upright substantially vertical position for carrying a work platform and having a platform carriage movable up and down responsive to a supporting cable on parallel rails longitudinally mounted on the tower. Means A are provided for mounting the horizontal work platform on the platform carriage in cantilevered relation on a lower portion of the platform carriage. A first pair of transversely spaced wheels B is carried on an upper portion of the platform carriage engageable with the rails on a side thereof remote from the work platform. A second pair of transversely spaced wheels C is carried on a lower portion of the platform carriage engageable with the rails on the other side of the rails. A stop member D is carried on the platform carriage opposite the first pair of wheels on the other side of the rails in spaced relation thereto. Wedging means E are carried by the carriage opposite the stop member held out of engagement with the rails by the supporting cable when the platform carriage is supported thereby. Thus, when said cable is no longer supporting the platform carriage, the wedging means engages the rails engaging the stop member and immobilizing the platform carriage.

Figure 1:
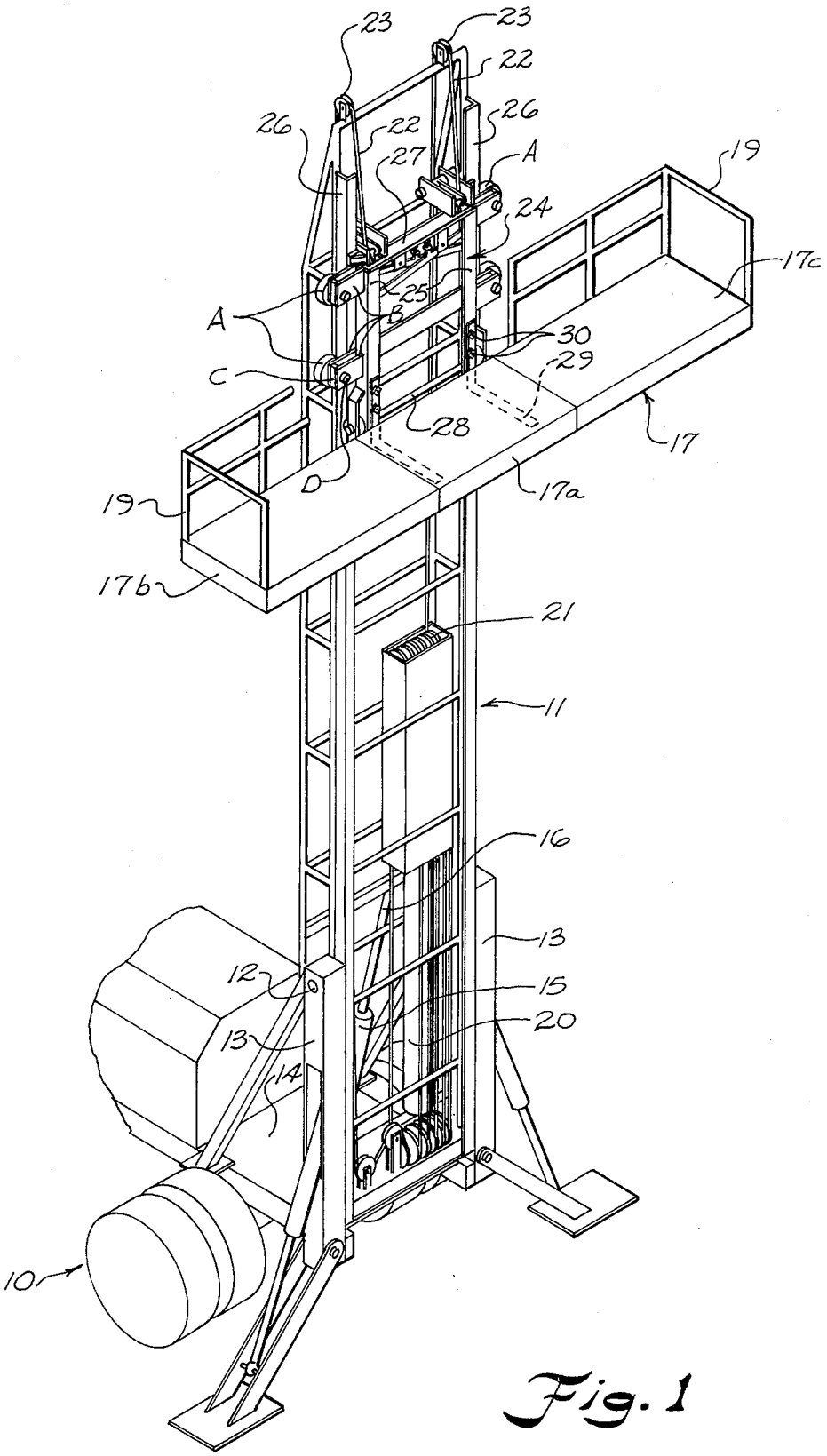
FIG. 1 is a perspective view looking from the left hand front of the vehicle illustrating the tower in raised position with a work platform fully extended laterally and in uppermost raised position on the tower.
Figure 4:
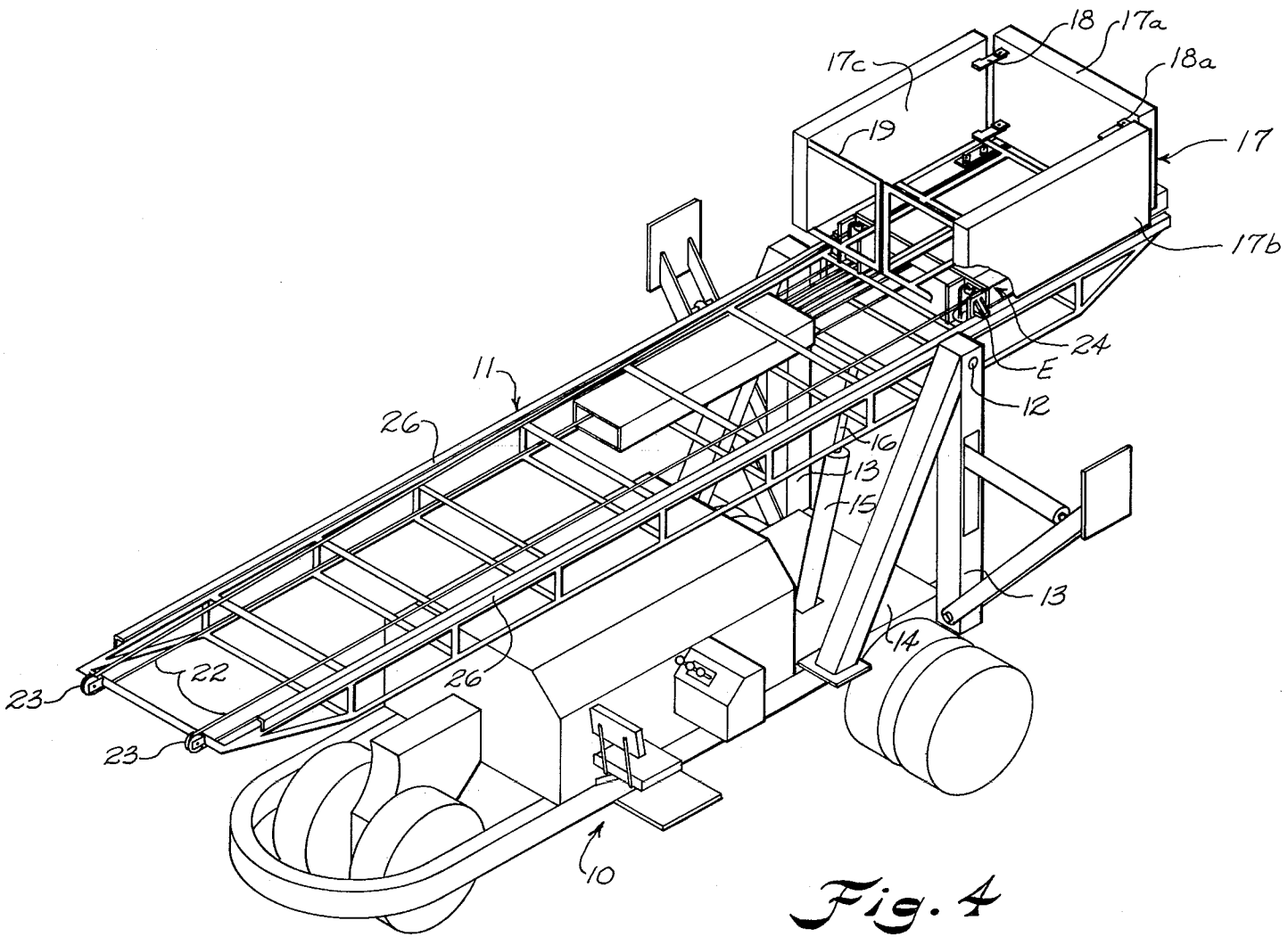
FIG. 4 is a perspective view looking toward the right hand front portion of a wheeled vehicle which carries the work platform lift assembly for movement from job to job with the safety mechanism of the invention in activated position so that the platform carriage is wedged and immobile with respect to the rails.

A power operated wheeled vehicle broadly designated at 10 is illustrated in FIGS. 1 and 4 for supporting a tower, broadly designated at 11. The tower 11 is pivotally connected as at 12 to each of a pair of transversely spaced vertical standards 13 fixed adjacent their lower ends to a platform 14 of the wheeled vehicle. The platform 14 carries a hydraulic cylinder 15 which is pivotally connected on one end thereto while a piston rod 16 extends from the other end thereof into pivotal engagement with the tower 11 for raising same from the substantially horizontal position illustrated in FIG. 4 to the substantially vertical position illustrated in FIG. 1. A work platform is broadly designated at 17 and includes a center section **17*a* with laterally extending sections 17*b* and 17*c* hingedly carried by respective sides thereof. The hinged sections are provided with hinge means 18 which are pivoted as at 18*a*. A suitable railing 19 is provided about each of the hinged platform sections 17*b* and 17*c*** for acting as guard rails for the workers carried on the work platform.

The work platforms of the present invention are of the type used as a substitute for scaffolding employed in the construction trade by such artisans as masonry workers, painters and the like.

Figure 2:
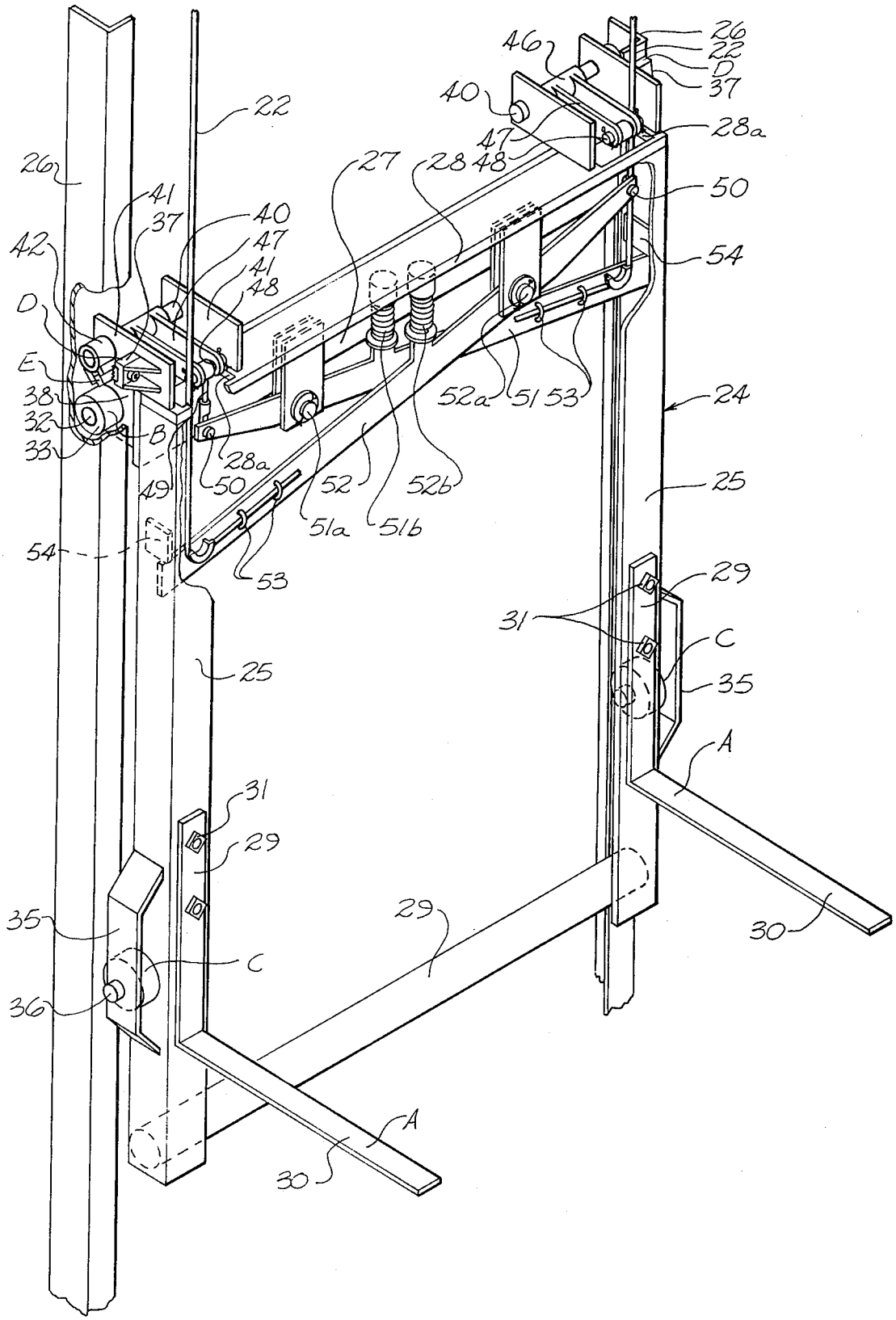
FIG. 2 is an enlarged perspective view illustrating the platform carriage of FIG. 1 with safety mechanism constructed in accordance with the present invention in deactivated position, the carriage being supported on the rails of the tower by spaced cables.
Figure 3:
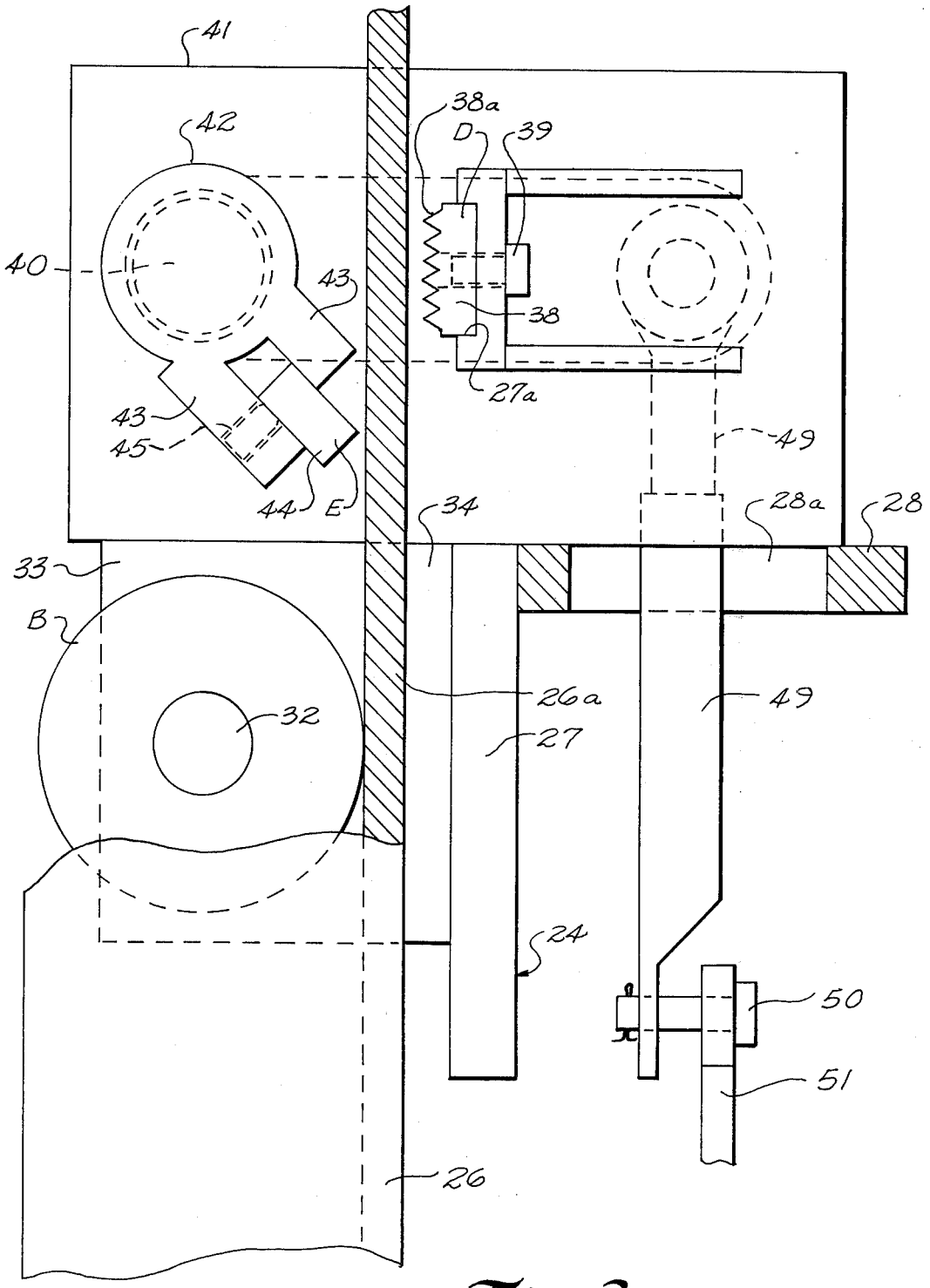
FIG. 3 is an enlarged side elevation of the upper carriage portion looking from the left hand side of FIG. 2 with parts broken away, illustrating details of the safety mechanism constructed in accordance with the invention with parts in deactivated position.

The cylinder 20 is illustrated in FIG. 1 as being fixed adjacent its lowered end with respect to the tower 11. The cylinder 20 operates, through a block and tackle arrangement 21, to multiply the cylinder's effectiveness in raising and lowering transversely spaced cable means 22 positioned adjacent opposite sides of the tower 11. The cable means 22 are carried by spaced sheaves 23 positioned adjacent the free end of the tower 11. The work platform 17 is carried on a platform carriage broadly designated at 24. Referring especially to FIG. 2, it will be noted that the platform carriage 24 includes a pair of spaced parallel angle irons 25 carried in alignment with the vertical rails 26 of the tower. The platform carriage is bridged transversely adjacent the top by a plate 27 and adjacent the lower portion thereby by a bar 29. The platform carriage 24 also includes an upper horizontal plate 28 (FIGS. 2 and 3). The horizontal plate 28 has openings **28*a*** adjacent each end thereof to accommodate linkage mechanisms which will be described below.

Means A for mounting the horizontal work platform 17 are illustrated in the form of L-shaped brackets each having a vertical leg 29 and a horizontal forwardly projecting portion 30. A preferably outwardly projecting leg 30 is assembled integrally into the work platform 17. By removing the nuts and bolts 31, the means A, together with the work platform, may be removed from the platform carriage. Thus, the work platform 17 is cantilevered forwardly outwardly of the platform carriage 24.

A first pair of transversely spaced wheels B is carried on an upper portion of the platform carriage. The wheels B are carried by stub shafts 32 positioned on suitable brackets 33 which may be secured to the platform as by welding as at 34 (FIG. 3).

The wheels B are engageable with the rails on the inner surface of a transverse web 26*a* of each of the rails 26 and restrain the carriage in such a position as to resist a tendency of the platform 17 to pivot downwardly. Thus, the platform wheels B support the carriage for movement on the rails on a side of the rails remote from work platform 24.

A second pair of transversely spaced wheels C is carried on a lower portion of the platform carriage engageable with the rails 26*a* on the other side thereof. The wheels C are carried by shafts 36 supported on one end by the brackets 35 and on the other end by the elongated parallel carriage members 25. Thus, the wheels C support the bottom of the carriage for rolling movement on an outer portion of the rails 26.

A stop member D is carried on the platform carriage opposite the first pair of wheels on the other side of the rails in spaced relation thereto. The stop member D includes a bracket portion 37 and such may be positioned on each side of the carriage. The bracket 37 carries a transversely disposed gripping member 38 having outwardly projecting teeth 38*a* within a slot 27*a* in the bracket 27 (FIG. 3). The toothed stop member 38 is secured as by suitable threadable fastening means 29 within the slot 27*a*.

By further reference, especially to FIG. 3, it will be noted that wedging means E are carried by the carriage opposite the stop member held out of engagement with the rails by the supporting cable when the platform is supported thereby. The wedging means E includes an oscillatable shaft 40 journaled in a pair of spaced supports 41 carried by the horizontal plate 28 of the platform carriage 24. The wedging means E further includes a collar 42 carrying inwardly projecting bifrucated portions 43 which carry a wedge 44 secured therebetween as by set screws 45. Referring now to FIGS. 2 and 3, it will be observed that a collar 46 carries an inwardly extending crank arm 47, the free end of which carries a shaft 48 which serves as a pivoted connection for a link 49. The link 49 has pivotal connection as at 50 on one end of a transversely extending arm 51. A link on the opposite side of the carriage also has pivotal connections as designated at 50 with a similar transversely extending link 52. It will be noted that the links 51 and 52 are pivotally supported as at 51*a* and 52*a* intermediate their ends. Each of the arms 51 and 52 have suitable fastening means 53 for securing respective cables 22 adjacent an end of the arms 51 and 52, respectively, remote from the pivotal connection 50. Suitable compression springs 51*b* and 52*b* normally urge the ends of the arms having pivotal connections 50 upwardly which, in turn, would cause engagement of the wedges 44 of the wedging means E with the transverse flanges 26*a* of the rails 26. A pair of opposed blocks 54 are carried by the inner surface of the outer flange of the angle irons 25 for limiting the upper movement of respective arms 51 and 52 as may damage the compression springs 51*b* and 52*b* which are illustrated in fully compressed position in FIG. 2. The tension in the cables 22 would tend to cause such upward movement of the arms.

Upon engagement of either or both of the wedging means E with the inner surface of the rail, which comprises the transverse webs 26*a* of the rails 26, such wedging action will cause the upper portion of the carriage 24 to move toward the left hand side in FIG. 3 engaging the teeth 38*a* of the stop member D with the web 26*a* of the rail 26. The wedge and the teeth of the stop member remain in wedged position until the necessary repairs have been completed. When the platform 17 is lowered on the tower 11 and the tower itself lowered to horizontal position, as illustrated in FIG. 4, the weight is taken off the cables 22 causing a wedging action as described above. Such action locks the platform carriage with respect to the rails for transport of the entire apparatus. When stopping the vehicle 10 during transport the locking mechanism will resist a tendency of the platform carriage to move forwardly on the tower 11.

While a preferred embodiment of the invention has been described using specific terms, such description is for illustrative purposes only, and it is to be understood that changes and variations may be made without departing from the spirit or scope of the following claims.

What is claimed is:

1. In a mobile work platform lift assembly wherein a wheeled vehicle carries a pivoted tower movable from a substantially lowered position to an upright substantially vertical position for carrying a work platform and having a platform carriage movable responsive to a supporting cable on parallel rails longitudinally mounted on said tower, the improvement including:

A. means mounting the horizontal work platform on said platform carriage extending outwardly in cantilevered relation on said platform carriage;

B. a first pair of transversely spaced wheels carried on an upper portion of said platform carriage engageable with the rails on a side thereof remote from the work platform;

C. a second pair of transversely spaced wheels carried on a lower portion of said platform carriage engageable with the rails on the other side of the rails;

D. a stop member opposite said first pair of wheels on said other side of the rails in spaced relation thereto;

E. wedging means carried by said carriage opposite said stop member held out of engagement by said supporting cable when said platform carriage is supported thereby;

F. an oscillatable shaft carried transversely of said platform carriage in horizontal alignment with a respective rail;

G. linkage means normally held by cable tension so as to maintain said wedging means in deactivated position;

H. resilient means normally urging said linkage means to move said wedging means into wedging engagement with said rail;

I. an outwardly extending crank arm fixed adjacent one end to said shaft;

J. a pair of arms extending across said platform carriage;

K. means pivotally supporting each of said arms with respect to said platform carriage in an intermediate portion thereof;

L. means connecting an adjacent end of each of said arms to a respective crank arm;

M. means connecting the other end of each arm to an adjacent cable;

O. a compression spring bearing against each arm intermediate said means pivotally supporting each of said arms and said means connecting the other end of each arm to an adjacent cable; and P. means limiting upper movement of said arms as a result of force exerted thereon by said cable;

whereby when said cable is no longer supporting said platform carriage said wedging means engages said rails engaging said stop member.

2. The structure set forth in claim 1, wherein said work platform extends outwardly from a lower portion of said platform carriage, and wherein said stop member is mounted on said carriage engageable with a rail when said cable for any reason no longer supports the carriage.

3. The structure set forth in claim 2 wherein said stop member is mounted in an upper portion of said platform carriage and is moved therewith by engagement of said wedging means with the rail to pivot said platform carriage inwardly about said second pair of wheels.

* * * * *